US005115828A

United States Patent [19]

Spaulding

[11] Patent Number: 5,115,828

[45] Date of Patent: May 26, 1992

[54] DEMOUNTABLE FRAME STRUCTURE

[75] Inventor: Stephen E. Spaulding, Coshocton, Ohio

[73] Assignee: Shaffer Tent & Awning Co., Coshocton, Ohio

[21] Appl. No.: 670,573

[22] Filed: Mar. 18, 1991

[51] Int. Cl.[5] ..... E04H 15/44

[52] U.S. Cl. ..... 135/106; 403/172; 135/108

[58] Field of Search ..... 135/101, 106, 107-109, 135/908, 909, 102, 87; 182/179; 403/176, 172, 171; 52/80, 81

[56] References Cited

U.S. PATENT DOCUMENTS

| | | | |
|---|---|---|---|
| 1,349,980 | 8/1920 | Richards | 135/101 X |
| 3,726,551 | 4/1973 | Levenberg | 403/172 |
| 4,105,348 | 8/1978 | Anderson et al. | 403/172 |
| 4,558,713 | 12/1985 | Hagler et al. | 135/106 |
| 4,562,681 | 1/1986 | Smith | 403/176 X |
| 4,838,003 | 6/1989 | Ziegler | 403/176 X |
| 4,948,289 | 8/1990 | Dellinger | 135/106 X |

FOREIGN PATENT DOCUMENTS

| | | | |
|---|---|---|---|
| 39236 | 10/1931 | France | 135/106 |
| 1294622 | 4/1962 | France | 135/106 |

*Primary Examiner*—David A. Scherbel
*Assistant Examiner*—Lan Mai
*Attorney, Agent, or Firm*—Francis T. Kremblas, Jr.

[57] ABSTRACT

A frame structure which possesses portable readily assembled and disassembled standardized components for erection of a semi-permanent tent structure in a generally rectangular form and provided with at least one pair of opposing hip roof sections. The vertical legs, horizontal beams and the conventional cross and hip rafters are removably connected by hook-like ends mounted in open bracket receptors. The primary rafters are removably fixed via a tongue telescoped within a hollow end socket of the rafters to provide extra stability and strength. The components are standardized to allow use of the same components with or without extension members to erect frame structures having variable dimensions. At least one crown connector is included to conveniently removably connect the rafters to a common crown and adapted for use with at least two different hip roof designs.

5 Claims, 8 Drawing Sheets

DEMOUNTABLE FRAME STRUCTURE

TECHNICAL FIELD

The present invention relates generally to temporary or semi-permanent frames for tent supporting structures and particularly to an improved tent frame structure comprising easily assembled and disassembled components which are readily portable between different erection sites.

BACKGROUND ART

There is a wide variety of tent frame structures ranging from the relatively simple and well-known pole types to the round tubular component types used to erect a temporary or semi-permanent tent. Over the last few decades there has been a significant increase in the need for renting a stable, demountable component tent frame structure which provides more stability, yet offers a luxurious, aesthetic appeal. Such structures are particularly in demand at various large outdoor events such as the Professional Golfers Association tournaments, prestigious auto races and the like. Therefore over the past few decades businesses have been developed to meet this demand for renting and erecting the frame and tent cover and for the disassembly and removal of the components. A more stable, semi-permanent type structure which resists inclement weather and relatively high winds are in high demand by the organizers of such multi-day events.

However, such a more stable frame structure requires component parts of somewhat heavier construction than prior frame elements. Therefore the difficulties relating to transport, assembly and disassemble are increased. Prior attempts to merely increase the strength of the component parts and to simplify their assembly and disassembly revealed significant problems which undesirably increased the cost of manufacture and transport, and the time to assembly and disassemble the frame. Further, increases in the inventory of components transported to each site was required permit to permit erection of frame structures having different sizes or shapes in order to meet the varying demands of each event.

While efforts to standardize various components have been made to attempt to meet customer demand, contain inventory costs and reduce the costs of assembly, further improvement has long been sought to more satisfactorily meet the demand for these more elaborate structures. This is particularly true in providing a stable roof configuration in the highly popular hip roof design wherein a plurality of rafter members must be joined at the roof crown in a stable manner.

SUMMARY OF THE INVENTION

The present invention relates to an improved tent frame structure of the type which is easily assembled and disassembled, yet provides a very stable structure. Such a frame structure has application for any temporary or semi-permanent type installation. Typically, large outdoor events which require a shelter for auxiliary activities associated with the event are one of the primary users of such tent structures. Such structures may be in use for a time ranging from a few days to a few weeks as may be required.

One example of such uses is certain prestigious professional golf tournaments wherein corporate sponsors, officials, participants and the press utilize several such tent structures for convenience as well as to accommodate the larger number of persons involved which would tax the permanent facilities at the site of the event.

In accordance with the present invention, an improved frame structure is provided which comprises a plurality of component parts which are standardized to readily accommodate assembly of a variety of sizes of sturdy frame structures to meet the needs of a given application. Further, such components are readily demountable and portable to permit easy transport from one site to a new location.

Another aspect of the present invention provides a very sturdy tent frame structure with a hip roof design which is highly desirable for aesthetic appeal at such events. This hip roof design incorporates the required rafter beams which are demountably connected to an improved common crown connecting means. This construction not only provides for quick connection and disconnection of the rafter components, but also easily accommodates two different hip roof designs and increases in size to reduce inventory requirements and initial capital costs.

As a further aspect of the present invention, the improved common crown connecting means includes a pair of opposing, outwardly extending tongue portions adapted to securely and removably receive one end of opposing primary rafters. The crown connecting means also includes two sets of three adjacent, closely spaced, bracket receptacles disposed on each side of the crown connector 90 degrees from the tongue portions. These bracket receptacles are adapted to receive hook-like attachment means disposed on one end of the side crown rafter and a pair of hip rafters.

The provision of standardized components including the rafter beams, which can be quickly fitted with extensions in combination with an improved common crown connector, provide an improved readily assembled and demountable frame structure which accommodates the requirements of ease of transport of the components from site to site, minimizes required inventory, and yet provides a highly stable tent frame compared to the prior art.

Figure 1:
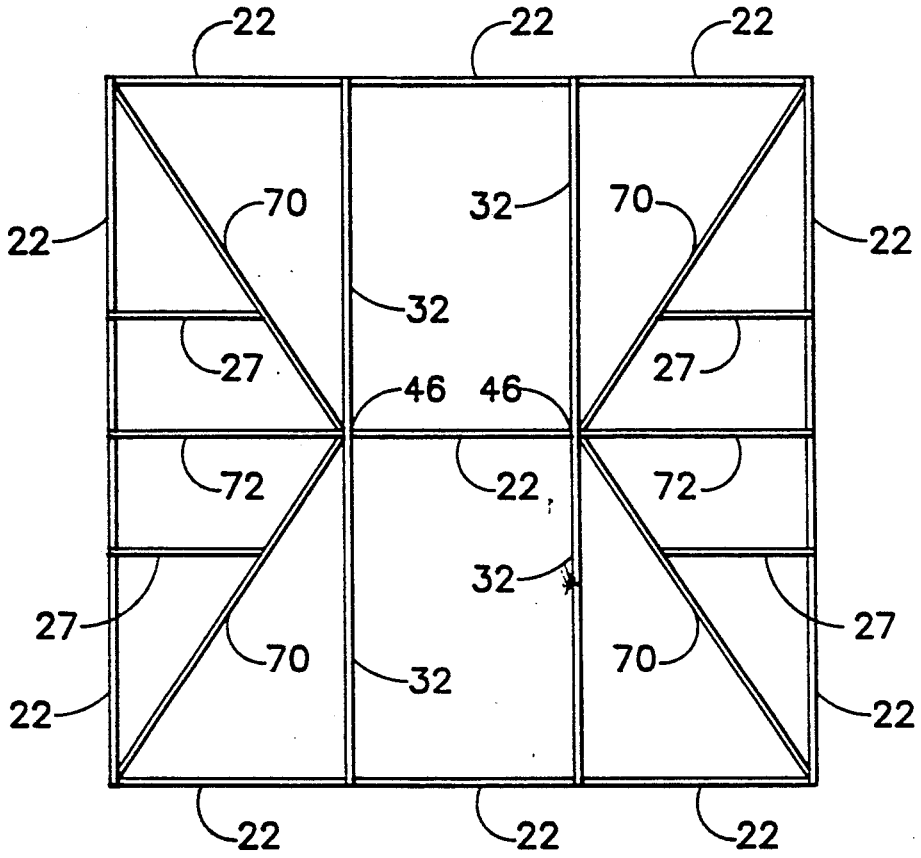
FIG. 1 is a top plan view of a demountable tent frame structure constructed in accordance with the present invention illustrating a design having one pair of opposing hip roof sections.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

Figure 2:
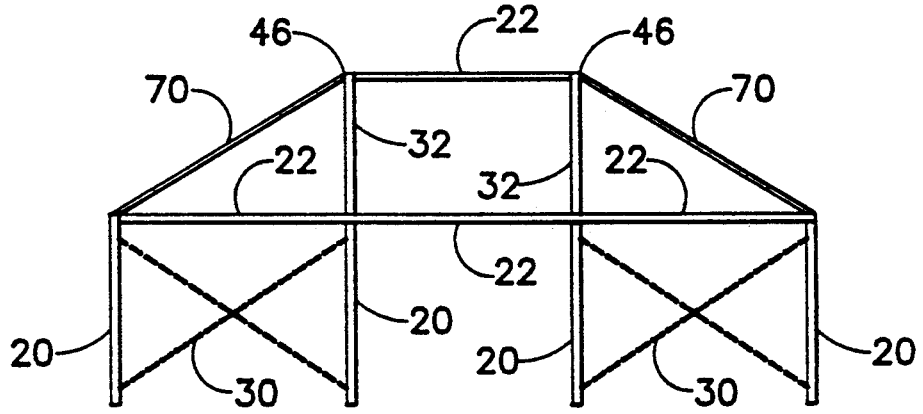
FIG. 2 is a side elevational view of the tent frame structure shown in FIG. 1.

A demountable tent frame structure constructed in accordance with the present invention is shown in FIGS. 1 and 2. The tent covering material which is conventionally attached to enclose the roof and sides, if desired, is not shown to more clearly illustrate the frame structure.

Figure 7:
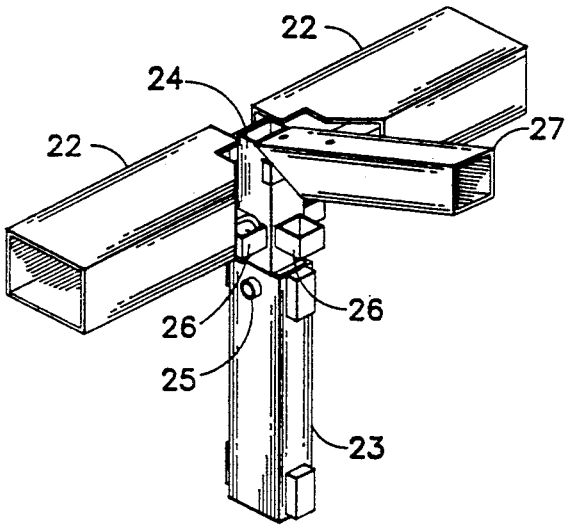
FIG. 7 is a partial view of the vertical leg assembly joining adjacent horizontal support beams and the outside end of a small perlin support member of the embodiments shown in FIGS. 1–4.
Figure 8:
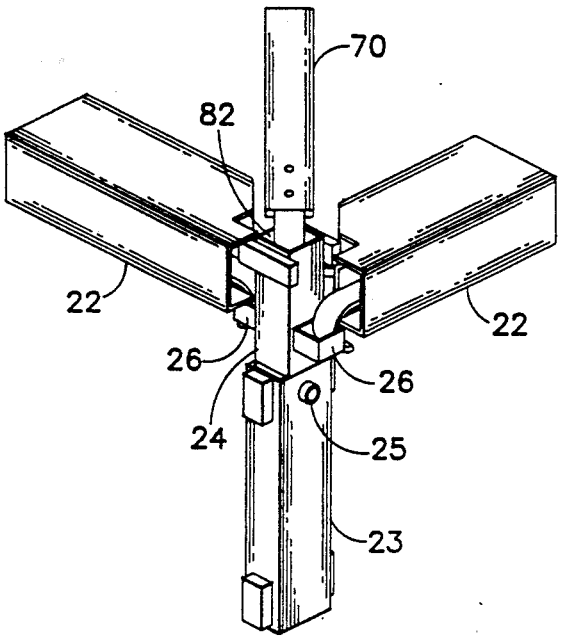
FIG. 8 is a partial view of a corner joining adjacent horizontal support beams with the outer end of a hip rafter'.
Figure 16:
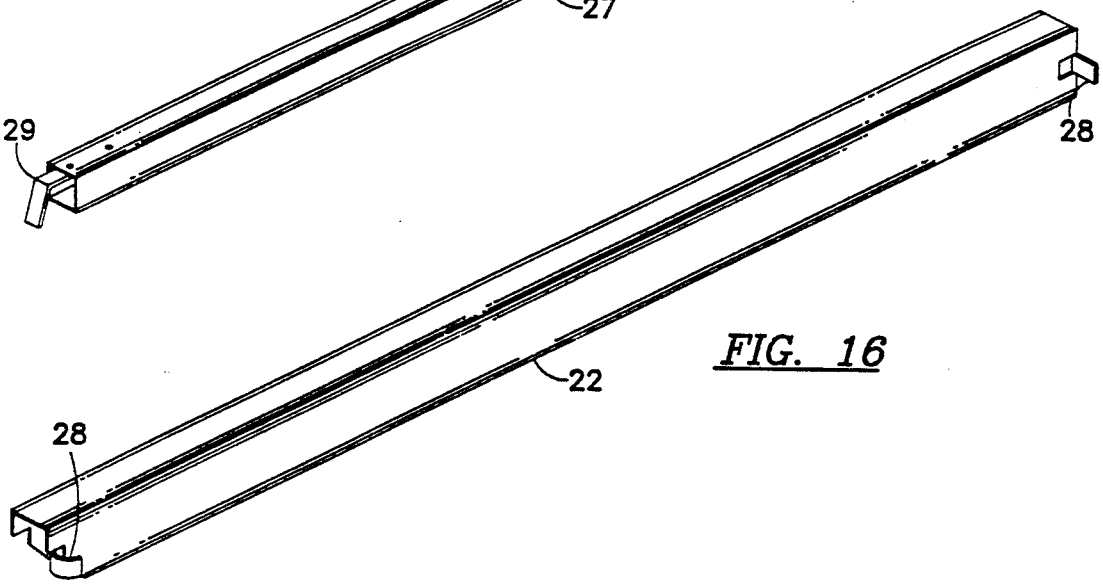
FIG. 16 is a perspective view of a large perlin or support beam forming a portion of the frame structure of the present invention.

The frame structure includes vertical leg supports, such as at 20, large perlins or horizonal support beams, such as 22, each of which are removably connected to one another via connector posts 23 carrying brackets 26. Bracket 26 receive hook-like connectors 28 fixed to opposing ends of large perlins 22 as seen in FIGS. 7 and 8 and FIG. 16.

A pair of guide wires, such as at 30, provided with an adjustable turnbuckle to vary the tension applied, are preferably operatively connected at each corner bay section, as seen in FIG. 2, to improve stability in a conventional manner.

Legs 20 may be suitable anchored to the ground in a conventional manner. One preferred manner, well-known to those skilled in the art, employs a large plate which itself is fixed to the ground via large stakes or pins, not shown. Typically the plate carries an upstanding, spaced pair of ears to which legs 20 may be removably fixed by pins extended through aligned holes in the legs and ears.

As seen in FIGS. 1 and 2, an opposing pair of primary or regular rafters are provided at 32 which are removably mounted at one end to a pair of common crown connecting means and to a rafter connector 34 at the other. The connection of rafter 32 with the rafter connector 34 is shown in FIG. 9 with rafter connector 34 shown apart from the assembled structure as seen in FIG. 23.

Figure 9:
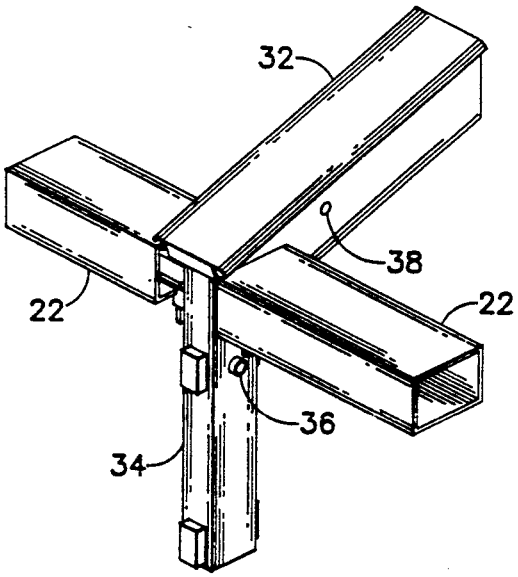
FIG. 9 is a partial view of a primary rafter assembly joining a vertical leg and adjacent horizontal support beams.
Figure 23:
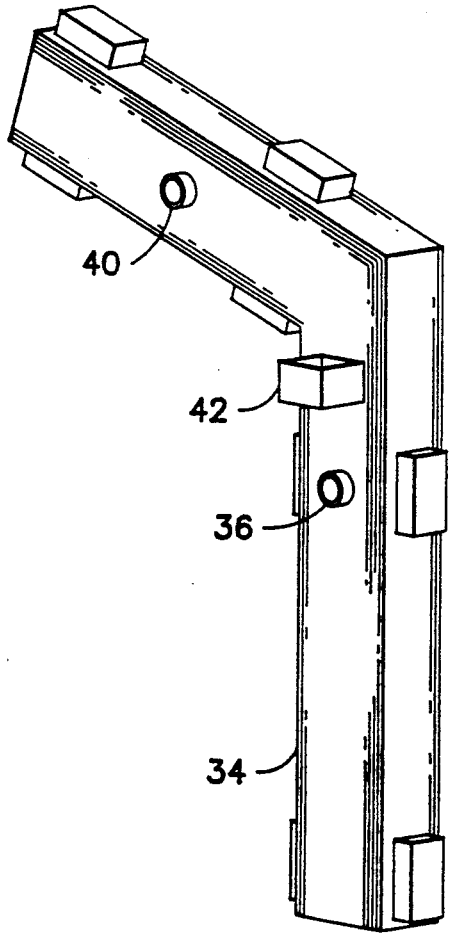
FIG. 23 is a perspective view of a primary rafter and perlin connection used in the frame structure of the present invention.

With reference to FIGS. 9 and 23, the vertical lower portion of rafter connector 34 is adapted to be slideably received into an open top forming a socket of leg 20, not shown, and is removably fixed to leg 20 via a pin, not shown, extended through the hole in leg 20 aligned with a tubular opening 36 provided in rafter connector 34.

In a similar manner hollow connector posts 23 are removably mounted to a respective leg 20 via a pin, not shown, extending through a hole in leg 20 and a hole 25 as seen in FIGS. 7 and 8. The smaller upper end portion 24 connector posts 23 comprises a square tube which is partially inserted into post 23 and welded to form a unitary construction. Hole 25 carries a round tube for accepting a pin and also functions as a vertical stop to support the lower end of upper end portion 24 which is fixed to post 23.

Figure 13:
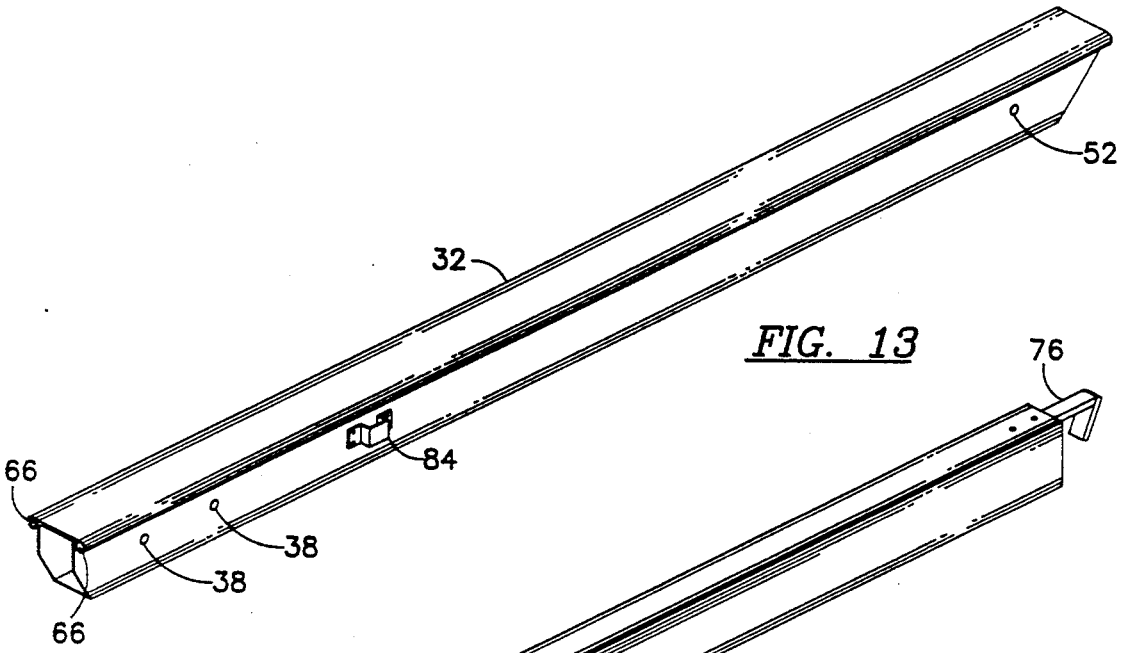
FIG. 13 is a perspective view of a regular or primary rafter forming part of the frame structure of the present invention.

With specific reference to FIGS. 9, 13 and 23, rafter 32 is telescoped over the upper angled portion of rafter connector 34 and removably fixed thereto via a pin, not shown, extended through the first of two holes 38 in rafter 32 and hole 40 provided in rafter connector 34. Hole 40 includes a fixed round tube for accepting a suitable pin in a similar manner as described regarding hole 25 provided in post connector 23.

Figure 17:
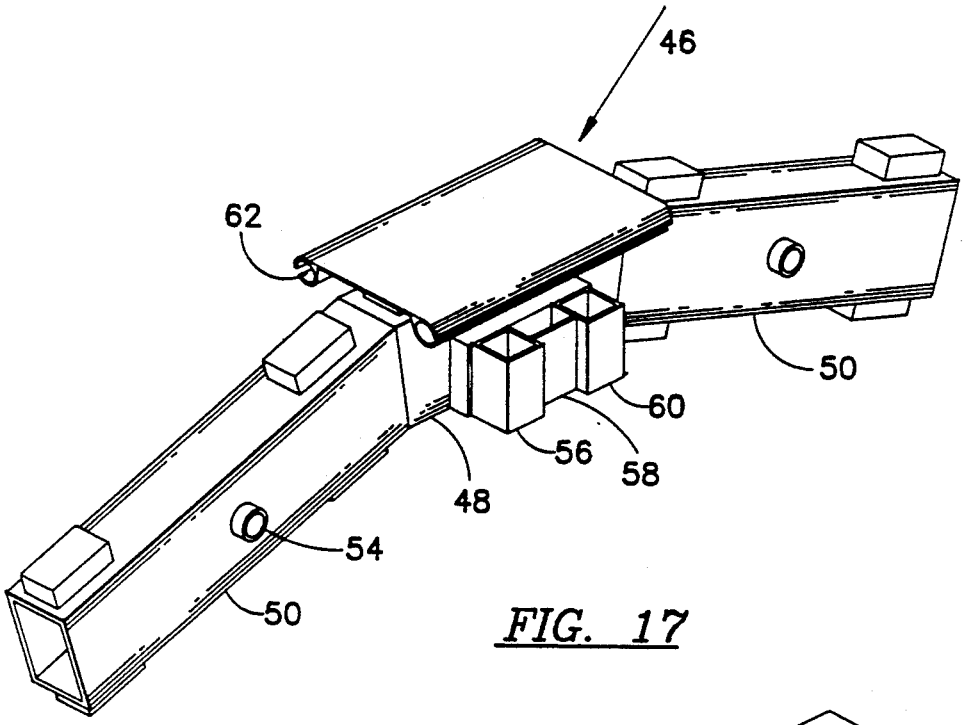
FIG. 17 is a perspective view of a crown connecting means forming a portion of the frame structure of the present invention.

Rafter connector 34 is also provided with open top brackets 42 on opposing sides of connector 34 which accept the hook-like connectors 28 provided on perlins 22. The upper end of an opposed pair of regular rafters 32 is removably connected to a common crown connector assembly, indicated generally at 46 in FIG. 17.

Crown connector assembly 46 includes a base 48 provided with a pair of oppositely extending tongue portions 50 welded or otherwise fixed to base 48. Each tongue 50 is adapted to telescope within the upper end of a respective regular rafter 32 and is removably fixed thereto via a pin, not shown, extended through a hole 52 in rafter 32 aligned with a hole 54 provided in a tongue 50.

Crown connector assembly 46 also includes a set of three adjacently disposed open top brackets 56, 58 and 60. Another set of three brackets, 56, 58 and 60 are preferably disposed on the opposite side of base 48 as seen in FIGS. 5 and 6 which are disposed at a right angle relative to tongues 50 so that the crown connecting assembly 46 may be commonly used for either of the hip roof configurations shown in FIGS. 1 or 3.

Preferably, a section forming a pair of channel tracks 62 is mounted to a block 64 welded or otherwise conventionally fixed to the top of base 48. Tracks 62 are matingly aligned with similar tracks 66 provided on rafter beam 32 to conventionally cooperate to aid in mounting and fixing the tent roof covering material in position over the roof of the frame structure. Such a track mounting system is incorporated in well-known prior art constructions to facilitate mounting of conventional synthetic tent roofing material over the roof frame and by itself forms no part of the present invention.

Figure 5:
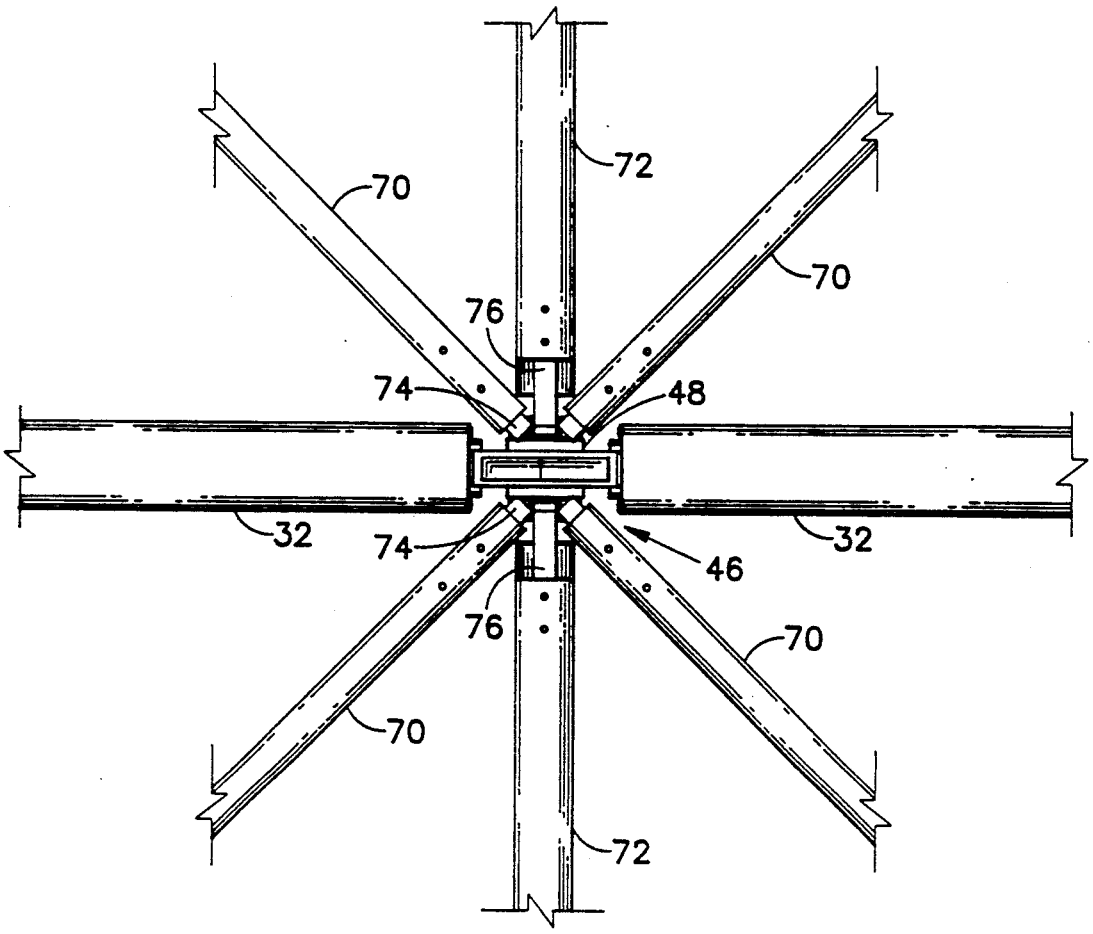
FIG. 5 is a partial plan view of the crown assembly illustrating the rafters assembled to a common crown connector to provide the four hip roof section design shown in the embodiment of FIGS. 3 and 4.
Figure 6:
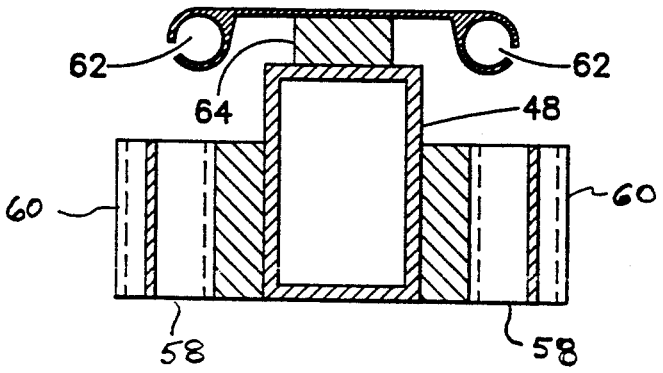
FIG. 6 is a side sectional view of the common crown connecting means shown in FIG. 5 isolated apart from the remaining structure; the section being taken along line 6—6 in FIG. 5.
Figure 12:
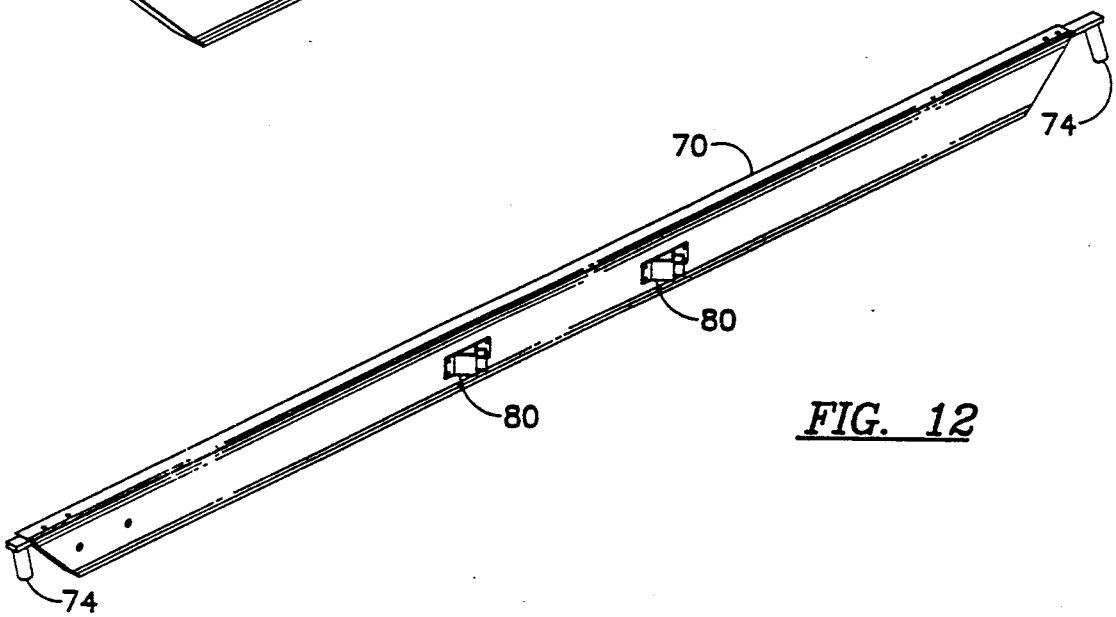
FIG. 12 is a perspective view of a hip rafter comprising a portion of the frame structure of the present invention.
Figure 14:
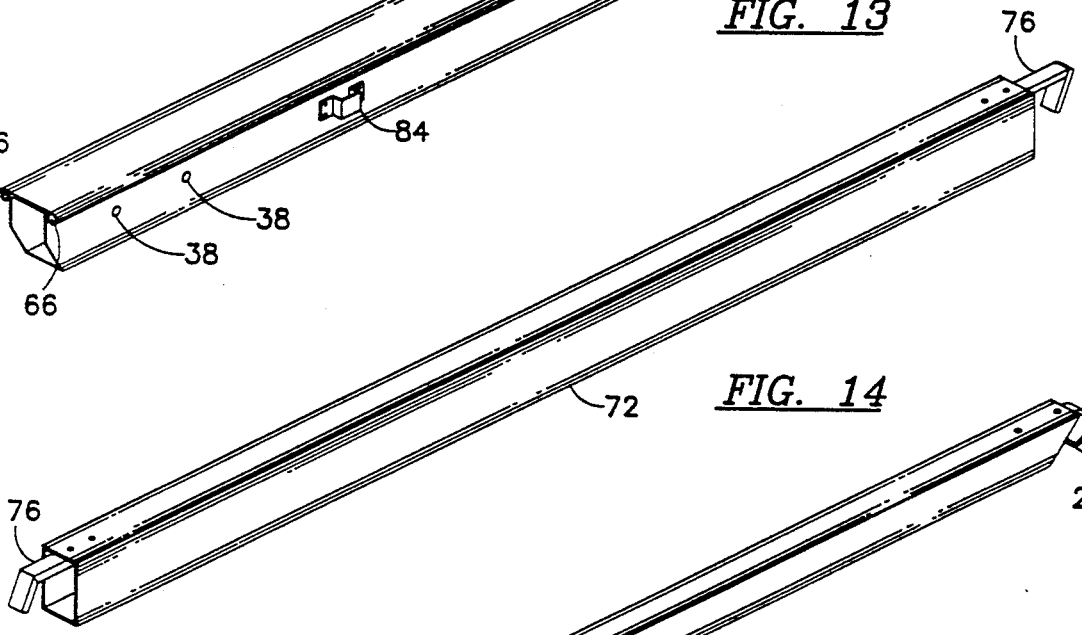
FIG. 14 is a perspective view of a side crown rafter comprising a portion of the frame structure of the present invention.
Figure 15:
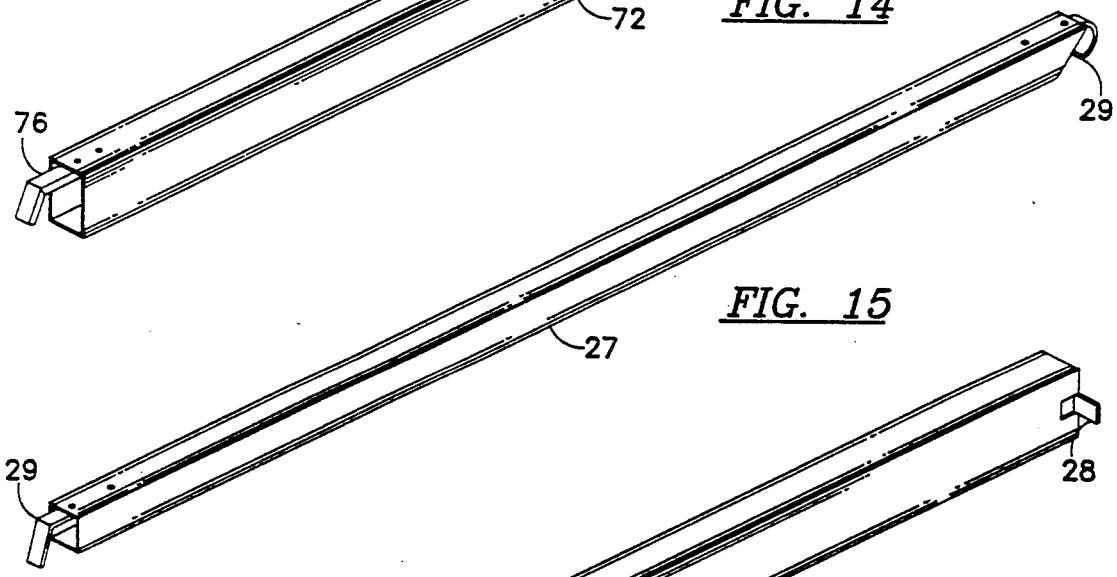
FIG. 15 is a perspective view of a small perlin or support beam forming a portion of the frame structure of the present invention.

Brackets 56, 58 and 60 are adapted to receive hook-like connectors 74 provided on the end of hip rafters 70 and connectors 76 provided on side crown rafters 72 as seen in FIGS. 12 and 14 and in the assembled view shown in FIG. 5. The hook-like connectors 74 provided on one end of hip rafters 70 are received in brackets 56 and 60. One of the hook-like connector 76 provided on side crown rafter 72 is received in the center bracket 58. The opposing hook-like connectors of hip rafters 70 and side crown rafters 72 are mounted in an open top of connector posts 27.

Figure 3:
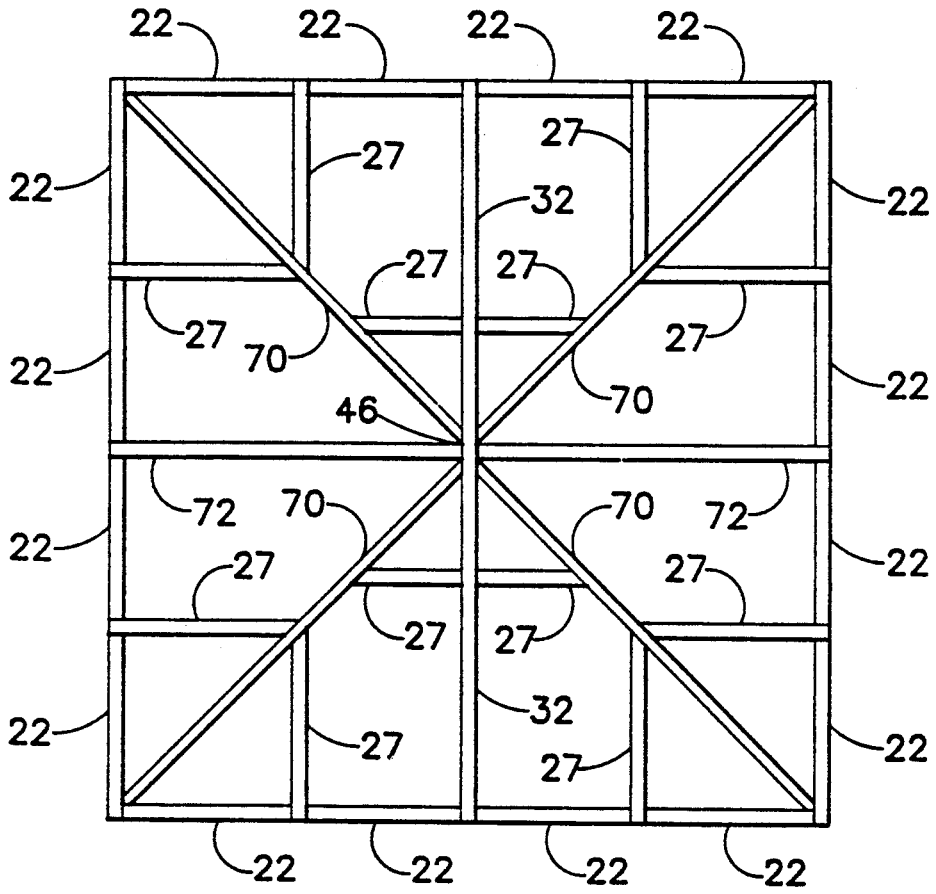
FIG. 3 is a top plan view of a demountable tent frame structure constructed in accordance with the present invention illustrating another preferred embodiment having a design including two pairs of opposing hip roof sections.
Figure 4:
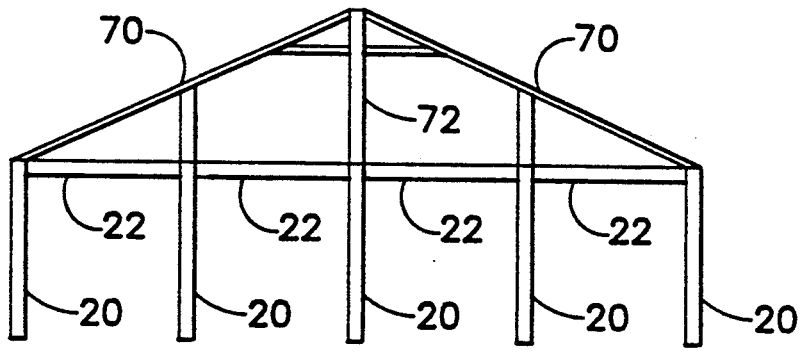
FIG. 4 is a side elevational view of the tent frame structure shown in FIG. 3.

The mounting assembly shown in FIG. 5, relates to the design incorporating two pairs of opposing hip roofs illustrated in FIG. 3. In the design having only a single pair of hip roofs as illustrated in FIG. 1, a pair of crown assemblies 46 is used and only one pair of hip rafters 70 and one side rafter 72 are removably connected to one of the sets of the three brackets 56, 58 and 60 facing the hip roof of a respective one of the crown assemblies 46. A large perlin 22 is removably connected to a respective bracket 58 of the inwardly facing set of three brackets of each crown assembly 46 as indicated in FIGS. 1 and 2. The remaining brackets 56 and 60 of the inwardly facing set of brackets are unused in this configuration, however, the crown assemblies 46 are identical to permit manufacture, stocking and transporting of one commonly constructed crown assembly adapted for either configuration. This significantly facilitates erection of either design at a given job site depending upon the different and varying needs of the given customer.

This common construction of crown assembly 46 eliminates confusion of the workers on the job site and the necessity of carrying extra sets of different crown assemblies to accommodate both types of hip roof designs.

Figure 22:
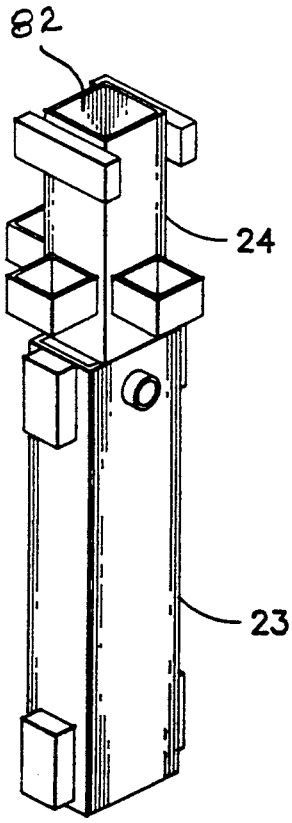
FIG. 22 is a perspective view of a perlin and corner connector used in the frame structure of the present invention.

Now referring to FIGS. 7, 8 and 22, connecting posts, such as 23 are provided at each corner of either of the frame designs shown in FIGS. 1 and 3 and at the intermediate junctions of large perlins 22, except for those junctions where regular rafters 32 are connected to rafter connectors 34.

At these intermediate junctions, smaller perlins 27 are connected to connecting posts 23 and a hip rafter 70 via an open bracket 26 and one of the hook-like connectors 29 at each end of perlin 27. The other end of small perlins 27 are removably connected to one of the open brackets 80 provided on hip rafters 70. The particular bracket 80 used depends on which hip roof design is employed.

The lower end of each hip rafter 70 is removably mounted to the connecting posts 23 disposed at each corner of the frame and is removably mounted thereto by insertion of one hook-like connector 74 into the top opening 82 in the upper portion of connecting post 23. The opposing end of hip rafter 70 is connected to crown assembly 46 as previously described herein. The lower end of side crown rafters 72 are similarly connected to a connecting post 23 as described in regard to hip rafter 70.

With respect to the four hip roof design shown in FIG. 3, a pair of small perlins 27 are preferably provided between regular rafters 32 and hip rafters 70 to improve stability. The small perlins 27 are removably connected between a bracket 84 provided on regular rafter 32 and one of the brackets 80 provided on hip rafters 70.

In view of the foregoing description it should be understood that a very stable and versatile frame structure is provided which employs easily erected components which are common to both a two or four hip roof design. Further, one can provide interlocking extensions adapted to lengthen the hip, regular and side crown rafters to easily increase the size of the frame structure using the same connector assemblies described herein to provide even grater versatility for erection of tent structures accommodating the on-site needs of a variety of outdoor events while minimizing the inventory of components which are required to be transported from one site to another.

Figure 10:
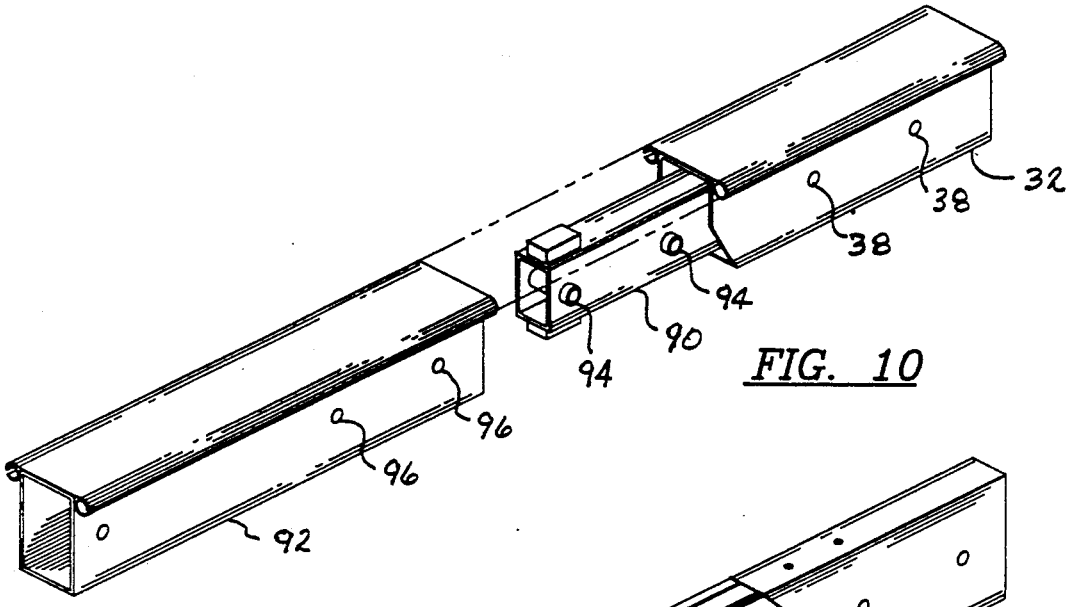
FIG. 10 is a perspective view illustrating a primary rafter, and an extension piece with a rafter extension connector in exploded relationship useful in the embodiment shown in FIGS. 3 and 4.
Figure 18:
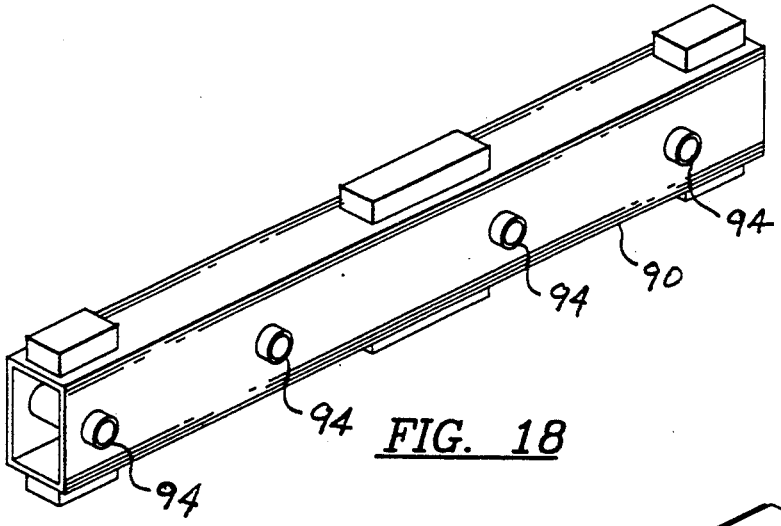
FIG. 18 is a perspective view of a primary rafter extension connector forming a portion of a preferred embodiment of the frame structure of the present invention.

A rafter extension connector 90 is shown by way of example in FIGS. 10 and 18 and is adapted to be partially slideably mounted within the end of a predetermined standard size regular rafter 32 and similarly received within a rafter extension member 92. The member 92 and rafter 32 are then removably connected by suitable pins disposed in holes 94 provided in connector 90 aligned with holes 38 provided in rafter 32 and 96 provided in extension member 92.

Figure 11:
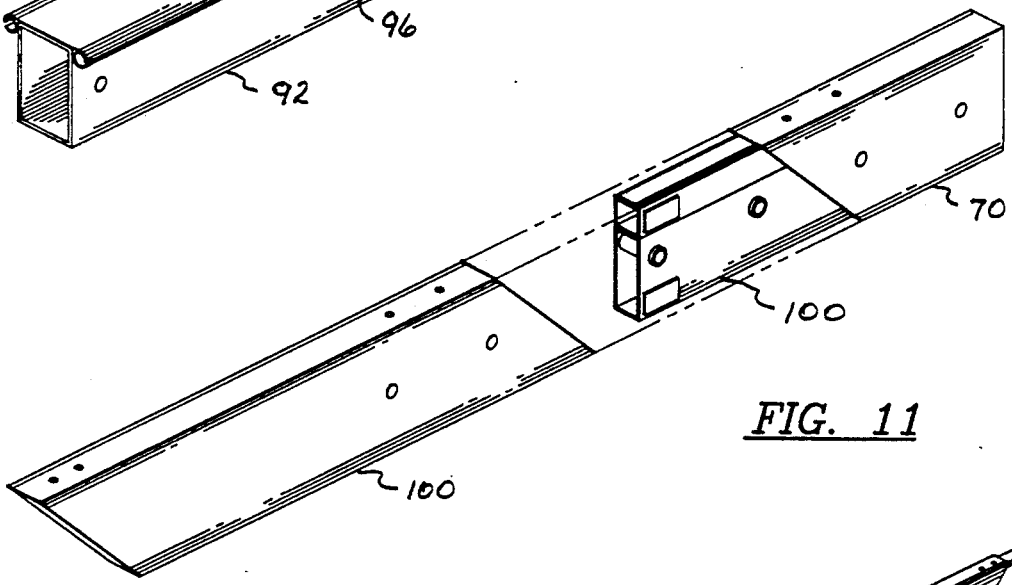
FIG. 11 is a perspective view illustrating a hip rafter, an extension piece and connector useful with the embodiment shown in FIGS. 3 and 4.
Figure 19:
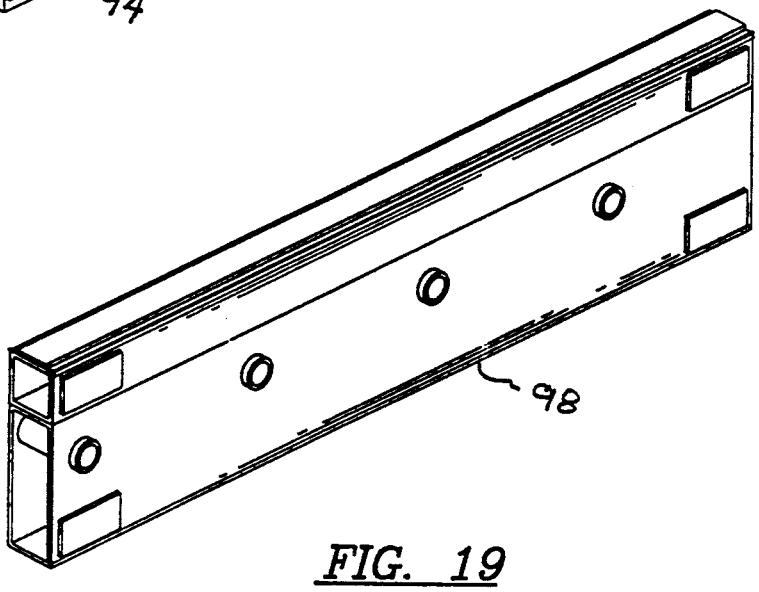
FIG. 19 is a perspective view of a hip rafter extension connector forming a portion of the frame structure of the present invention.
Figure 20:
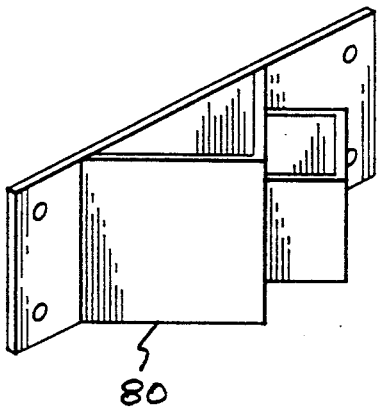
FIGS. 20 and 21 are perspective views of two perlin brackets used in the frame structure of preferred embodiments of the present invention.
Figure 21:
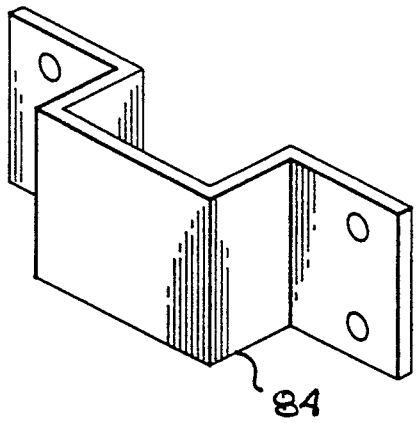

A hip rafter connector 98 and hip rafter extension member 100 are shown in FIGS. 11 and 19. Connector 98 is telescoped and removably fixed within extension member 100 and hip rafter 70 in a similar fashion as described above via pins, not shown, extended through aligned holes in each of the components.

Generally identical components, not shown, are also employed in a similar manner to permit extension of side crown rafters of a standard size to a longer length.

This feature reduces the requirement for transporting different full size rafter components and yet allows a very useful degree of flexibility to increase the area of a particular frame design utilizing primarily the same components.

While certain preferred embodiments of the present invention have been disclosed in detail, it is to be understood that various modifications may be adopted without departing from the spirit of the invention or scope of the following claims.

I claim:

1. In a modular tent frame structure of the type including portable components readily assembled or disassembled in either one of a two or four hip roof design the combination of:

a) a plurality of vertical leg members and horizontal support members removably connected to one another to define a generally rectangular frame;

b) a plurality of supporting rafters removably connected between said generally rectangular frame and one or more crown connecting means to define at least a roof frame including at least two opposing hip roofs;

c) said crown connecting means including a pair of outwardly extending, opposing tongue portions, each of said portions conformed to be removably telescoped within one end of one of said supporting rafters and at least two sets of three open bracket receptacles, each of said sets extending outwardly in opposing directions relative to one another;

d) and wherein the remaining ones of said rafters include hook-like connectors disposed at their opposing ends, at least one of said hook-like connectors of each of said remaining rafters being removably received in at least a respective one of said three bracket receptacles of one of said sets of bracket receptacles to form at least one of said plurality of hip roofs.

2. The tent frame structure defined in claim 1 including a plurality of vertically extending post members having a generally rectangular configuration, each of said post members removably connected to the upper portion of said vertical leg members disposed at a corner junction of said rectangular frame and including an open bracket receptacle disposed on at least two opposing sides and a top opening, said top opening conformed to removably receive one of the hook-like connectors of one of said rafters with the other hook-like connector at the opposing end of said rafter received in one of said bracket receptacles of said crown connecting means.

3. The tent frame structure defined in claim 1 wherein all of said rafters are removably connected at one of their ends to only one crown connecting means to form a roof frame having four hip roofs joined at said one crown connecting means.

4. The tent frame structure defined in claim 1 wherein said rafters have a selected length to form a predetermined roof frame area and including a plurality of rafter extension members and a plurality of rafter extension connecting means, a respective one of said extension connecting means being slideably extended in a removably fixed relationship partially within a respective one of said rafter extension members and a respective one of said rafters, the outwardly extending ends of said rafter extension members provided with a hook-like connector removably mounted to one of said bracket receptacles of said crown connecting means to form an enlarged hip roof frame area relative to the predetermined area formed by said rafters having a selected length.

5. A modular frame structure including portable demountable components to form at least one pair of opposing hip roof portions and is adapted for assembly and disassembly on site comprising in combination:

a) a plurality of vertical leg members removably fixed to the ground;

b) a plurality of horizontally disposed support members, each one being removably connected to the upper portion of a pair of adjacently disposed vertical leg members to generally define an enclosed rectangular frame having four corner junctions;

c) at least one pair of first rafter beams, each having one end provided with a hollow tongue receptor, each of said first rafter beams extending in longitudinally aligned, relationship to one another and removably mounted between at least one crown connecting means and a different one of said horizontal support members;

d) at least one pair of second rafter beams, each having a hook-like connector fixed at one end thereof and extending at a right angle to said first rafter beams and removably connected between said at least one crown connector and to a different one of said horizontal support members;

e) at least two pair of hip rafter beams having at least one end provided with a hook-like connector, said hip rafter beams extending between and removably connected to said at least one common crown connecting means and a different one of said corner junctions of said rectangular frame; and f) said crown connecting means including a body portion provided with a pair of tongue portions, each of said tongue portions extending outwardly from a pair of opposing sides of said body portion and a different one of said tongue portions received within a different one of said tongue receptors of said at least one pair of first rafter beams; and g) at least two sets of three, adjacent, closely spaced, open top bracket receptacles, a respective one of said sets fixed to different opposing sides of said body portion disposed generally at a right angle to the opposing sides carrying said tongue portions, and wherein the hook-like connectors on the end of at least one of said second rafter beams and at least one pair of said hip rafter beams are releasably engaged in a different one of said bracket receptacles of one of said sets of bracket receptacles of one of said crown connecting means.

* * * * *